United States Patent [19]

Patel

[11] 3,938,941

[45] Feb. 17, 1976

[54] CONTROL SYSTEM

[75] Inventor: Jaykishan C. Patel, Clinton, Iowa

[73] Assignee: General Electric Company, Fort Wayne, Ind.

[22] Filed: Sept. 9, 1974

[21] Appl. No.: 504,252

[52] U.S. Cl. ..... 431/80
[51] Int. Cl.[2] ..... F23N 5/12
[58] Field of Search ..... 431/71, 78, 80, 25, 26

[56] References Cited

UNITED STATES PATENTS

| | | | |
|---|---|---|---|
| 3,645,661 | 2/1972 | Goodman | 431/78 X |
| 3,674,410 | 7/1972 | Wade | 431/78 X |
| 3,822,981 | 7/1974 | Walbridge | 431/78 |

*Primary Examiner*—Edward G. Favors
*Attorney, Agent, or Firm*—Joseph E. Papin

[57] ABSTRACT

A low voltage thermostatically energizable control system for a fuel burner having a fuel valve and operable from a direct current. The control system includes means for actuating the fuel valve to enable flow of a combustible fuel from the burner and means for spark igniting the fuel emitted from the burner. Means for detecting a flame is disposed near the burner, and the impedance between the detecting means and a point of reference potential is greater when no flame is present at the burner and is lower when a flame is present at the burner. A semiconductor device is coupled to the detecting means for conducting current only when the impedance between the detecting means and the point of reference potential is lower thereby to indicate the presence of a flame, and means is responsive to the current conducted by the semiconductor device for disabling the spark igniting means.

28 Claims, 4 Drawing Figures

CONTROL SYSTEM

RELATED APPLICATION

This application is related to copending application Ser. No. 486,004, filed July 5,1974.

BACKGROUND OF THE INVENTION

The present invention relates generally to a control system for a fuel burner and more particularly to a low voltage control system of the direct ignition type.

In the past, control systems for fuel burners, such as gas furnaces or the like, typically provided a thermostat to open a fuel valve when the thermostat indicated a demand for heat and also typically provided means for automatically igniting fuel emitted from the burner. Ignition may have been achieved by a small pilot flame which burned continuously or may have achieved by using a spark or arc ignitor which provided a spark in the vicinity of the burner at about the same time or soon after the fuel valve was opened.

Recent improvements in burner control units of the abovementioned type are well illustrated by U.S. Pat. No. 3,734,676 which discloses a control system for a fuel burner. In this patented control system, an ignitor and a controlled switching device are effective when gated to connect the ignitor to a source of electrical energy for providing pulses of electrical energy to the ignitor. This patented control system has a gate circuit including a capacitance for providing gate signals to the controlled switching device. These gate signals are provided so long as the capacitance has a charge below a specified level and the capacitance is initially provided with a charge above that specified level. The capacitance charge is reduced with time so as to gate the controlled switching device to operatively connect the ignitor to a source of electrical energy only after a predetermined period of energization of the control system thereby to effect pre-ignition purging of the burner area to insure there is not an over abundance of fuel when ignition occurs.

Control systems of the type illustrated in the aforementioned U.S. patent function quite well but may be thought of as typically operating on a 120 volt alternating current supply or employing a step-up transformer from the commonly encountered low voltage thermostat systems which typically operate around 24 volts A.C. Control system according to the aforementioned patent and the aforementioned copending application function well but may not lend themselves to some particular applications, such as mobile heating environments or the like where direct current or optional alternating current-direct current operation is desirable.

SUMMARY OF THE INVENTION

Among the several objects of the present invention may be noted the provision of an improved low voltage thermostatically energizable control system for a fuel burner; the provision of such control system in which the components of at least the ignition and flame monitoring portions are solid state; the provision of such control system operable from either low voltage A.C. or D.C. unregulated source; the provision of such control system having relatively low power consumption; the provision of such control system characterized by its fail safe mode of operation; the provision of such control system having an improved spark ignitor for a fuel burner; the provision of such control system having an improved flame detecting circuit for a fuel burner; the provision of such control system in which power transformers and electro-mechanical relays are eliminated; and the provision of such control system which is simplistic in design, economical to manufacture, and high reliability. Other objects and features will in part apparent and in part pointed out hereinafter.

In general and in one form of the invention, a low voltage control system is provided for a fuel burner having a fuel valve and is adapted to be operable from a direct current. The system has means for actuating the fuel valve to enable flow of a combustible fuel from the burner, and means for spark igniting the fuel emitted from the burner. Means is provided for detecting a flame disposed near the burner, and the impedance between the detecting means and a point of reference potential therefor is greater when no flame is present at the burner and lower when a flame is present at the burner. A semiconductor device is coupled to the detecting means for conducting current only when the impedance between the detecting means and the point of reference potential is lower thereby to indicate the presence of a flame, and means is responsive to the current conducted by the semiconductor device for disabling the spark igniting means.

Also in general, a direct current energizable low voltage control system in one form of the invention is provided for enabling a fuel valve of a fuel burner. The system has means for actuating the fuel valve and a semiconductor device in series circuit relationship therewith wherein current flow therethrough enables the fuel valve to effect a flow of a combustible fuel from the burner. Means is responsive to system energization for rendering the semiconductor device conductive a predetermined time after system energization, and means is provided for igniting the fuel emitted from the fuel burner. Means is disposed near the fuel burner for detecting when a flame is present, and means is coupled to the detecting means for interrupting the current flow through the actuating means another predetermined time after system energization only if the detecting means does not indicate that a flame is present.

Further in general, a low voltage thermostatically energizable control system is provided in one form of the invention for a combustible fuel burner having a fuel flow control valve. The system includes means for actuating the control valve to effect flow of a combustible fuel from the fuel burner. Means is disposed near the fuel burner for indicating when a flame is present, and means is also disposed near the fuel burner for defining a spark gap. A low voltage to high voltage converter is coupled to the spark gap defining means for causing an arc across the spark gap when enabled. The convertor includes a pair of step-up transformer devices, and a threshold discharge circuit interconnecting the step-up transformer devices. One of the step-up transformer devices receives a low voltage input and provides an increased voltage output to the threshold discharge circuit, and the other of the step-up transformer devices is enabled by a discharge of the threshold discharge circuit to provide a high voltage output to the spark gap defining means. Means is provided in circuit relation with the one step-up transformer device for inducing oscillations therein when current from a low voltage source is allowed to flow therethrough.

BRIEF DESCRIPTION OF THE DRAWINGS

Corresponding reference characters indicate corresponding parts throughout the several views of the drawing.

The following exemplifications set out herein illustrate the preferred embodiments of the invention in one form thereof, and such exemplifications are not to be construed as limiting the scope of the invention in any manner.

DESCRIPTION OF THE PREFERRED EMBODIMENTS

Figure 1:
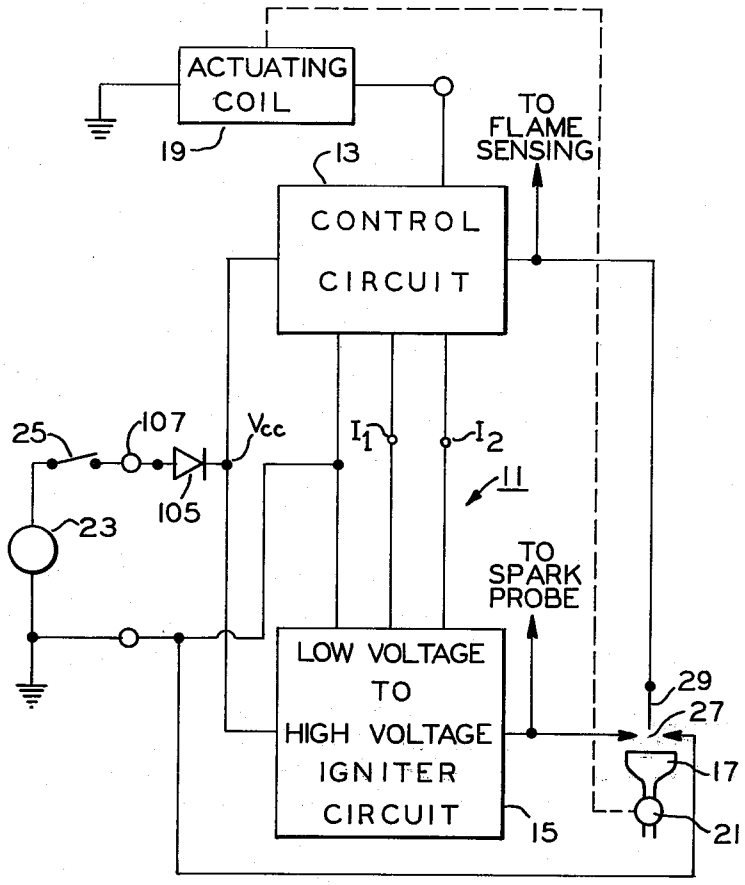
FIG. 1 is a schematic block diagram of a control system in one form of the invention.

Referring now to the drawing in greater detail, there is illustrated generally at 11 in FIG. 1 a control system for a fuel burner, and the control system includes a control circuit 13 and a low voltage to high voltage converter or ignitor circuit 15 for igniting fuel emitted from a burner 17. An actuating means or valve actuating means, such as an actuating coil 19, enables, on command, a valve 21 to allow fuel to flow from burner 17. Control system 11 is energized from a low voltage source 23 when a thermostatically controlled switch 25 closes indicating a demand for heat. Ignitor circuit 15, when enabled, supplies a high voltage to a spark gap 27 for igniting the fuel, and a flame detecting sensor or probe 29 senses an impedance drop indicative of the presence of a flame to disable the ignitor circuit and stop fuel flow in the event that ignition is not achieved. The function of control circuit 13 will be more clearly understood by referring to FIG. 2.

Figure 2:
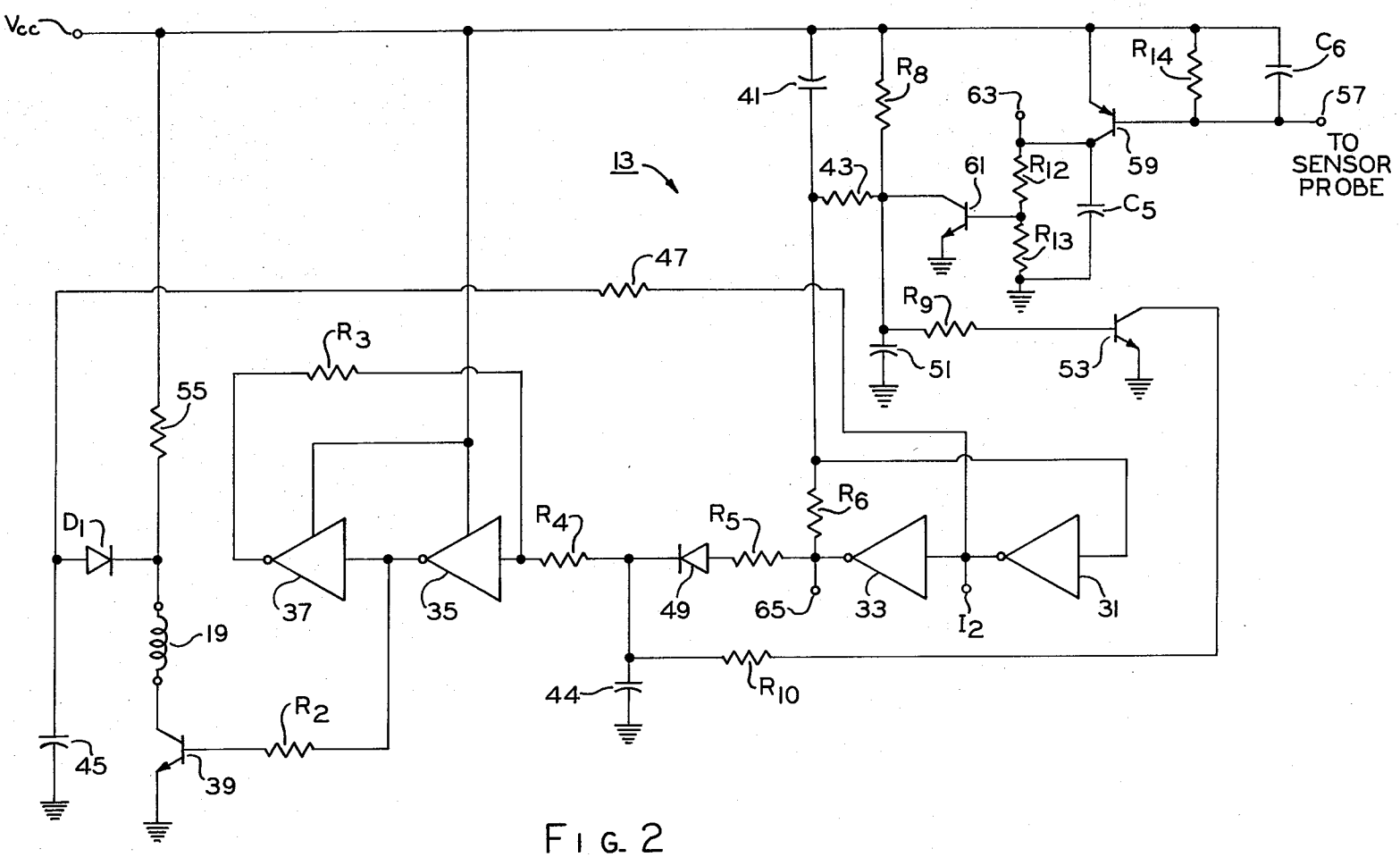
FIG. 2 is a more detailed schematic diagram of the control system of FIG. 1.

In FIG. 2, control circuit 13 is implemented employing a series of metal-oxide semiconductor inverting gates 31, 33, 35, 37 with fuel valve actuating coil 19 being enabled when a transistor 39 conducts provided capacitor 45 has been charged. When thermostatic switch 25 of FIG. 1 closes, a direct current $V_{cc}$ is applied to control circuit 13, and since a capacitor 41 is initially discharged, this voltage is applied as an input to gate 31. Therefore, the output of gate 31 is low, and similarly the output of gate 33 is high to charge capacitor 44 and supply a high input to gate 35, the low output of which turns transistor 39 off. The time constant associated with capacitor 41 and a resistor 43 may be relatively short, for example in the order of 0.01 seconds, and when capacitor 41 is charged, the input of gate 31 goes low with its output going high to begin the charging of capacitor 45 by way of a resistor 47. This high output of gate 31 may also, by way of terminal $I_2$ (FIG. 1), be employed to enable ignitor circuit 15 and initiate a spark in the vicinity of burner 17. A high output from gate 31 causes the output of gate 33 to go to its low state, however, the charge on capacitor 44 remains relatively high due to the presence of a diode 49. Thus, transistor 39 remains, at least for the time being, in its non-conducting state. When thermostatic switch 25 (FIG. 1) closes, a capacitor 51 also began to charge; however, due to a much longer time constant, this capacitor will achieve a charge of, for example, about 0.8 volts within 1 second. When this voltage level is reached, a transistor 53 turns on discharging capacitor 44 and lowering the input to gate 35, the output of which then goes high enabling transistor 39. When transistor 39 conducts, current $V_{cc}$ is supplied to valve actuating coil 19, and additionally, since capacitor 45 has been charging during the process, an additional surge of starting current is supplied from capacitor 45 to the valve actuating coil. So long as transistor 39 is energized, the valve actuating coil 19 is maintained in its state for enabling the flow of gas or other combustible fuel from burner 17 by current through a resistor 55. If for some reason capacitor 45 is not charged or transistor 39 closes before the capacitor is charged, then actuating coil 19 cannot sufficiently energize to enable gas valve 21 thereby to provide a fail-safe operating mode. A gas valve with a special coil having definite higher pick-up current and lower drop-out current characteristics (or an equivalent relay) may be employed within the scope of the invention so that actuating coil 19 may enable the gas valve only when capacitor 45 provides a relatively higher surge. Resistor 55 may provide the holding current after actuating coil 19 has picked-up.

When ignition occurs, the impedance between a terminal 57 and ground decreases substantially thereby to turn on a transistor 59 which, in turn, turns on another transistor 61, and conduction of transistor 61 discharges capacitor 51. The charge on capacitor 44 remains low, and gate 35 continues to supply a high output maintaining transistor 39 in its conducting state. If, however, ignition fails, transistors 59, 61 remain non-conducting. The charge on capacitor 51 continues to build until gate 31 receives a high input thereby to provide a low output and cause a high output from gate 33 to lower the output of gate 35 turning transistor 39 off and locking out gas valve 21. The low output from gate 31 also allows capacitor 45 to discharge by way of resistor 47. The circuit typically would be manually reset by disconnecting the supply voltage for discharging the capacitors involved. A high output from gate 31 called for a spark from ignitor circuit 15 by way of terminal $I_2$ (FIG. 1), and the ignitor circuit may be turned off due to conduction of transistors 59, 61 indicating successful ignition by the high voltage which appears at a terminal 63 at this time or may be turned off by the high voltage appearing at a terminal 65 when lock-out occurs. Both functions may be achieved by connecting a simple "or" gate between terminals 63, 65 as inputs and terminal $I_1$ of FIG. 3 as an output. It may be noted that circuit 13 of FIG. 2, as discussed above, provides a fail-safe mode of operation, i.e., if any critical component, such as any gate, transistor or diode, fails the circuit arrangement is such that capacitor 45 does not charge-up. Further, as previously noted, if transistor 39 closes before capacitor 45 is charged or if the transistor remains open, gas valve 21 cannot be opened.

Figure 3:
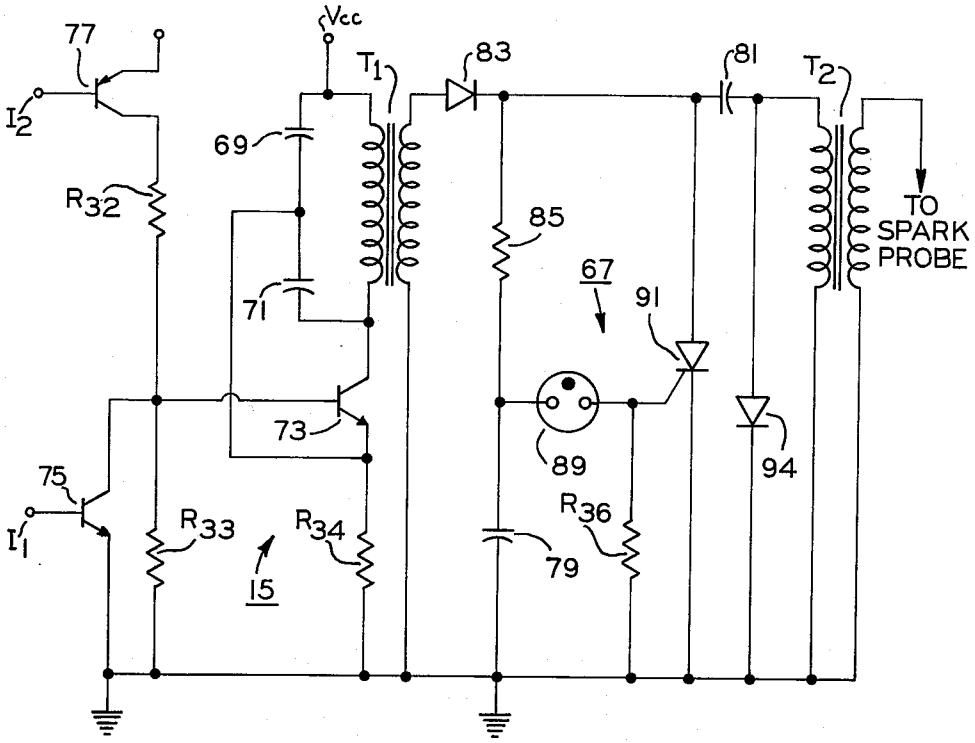
FIG. 3 is a detailed schematic diagram of the ignitor of FIG. 1.

In FIG. 3, a pair of voltage step-up devices or transformers $T_1$, $T_2$ are provided, and a secondary winding of transformer $T_2$ is coupled to the spark probe near burner 17. In practice, a spark gap near burner 17 may be defined between a probe extending close to the burner and the burner itself which may be grounded. Transformers $T_1$, $T_2$, are interconnected by a threshold discharge circuit 67, and a primary winding of transformer $T_1$ receives a low voltage input current $V_{cc}$. In operation, when no spark is called for, a pair of capacitors 69, 71 will charge to opposite polarities since a transistor 73 is not conducting. Non-conduction of transistor 73 may be insured by conduction of a transistor 75 which, as was noted earlier, receives a "spark off" signal on terminal $I_1$. If a spark is now called for, transistor 73 is turned to its non-conducting state, and a transistor 77 receives a "spark on" signal from terminal $I_2$. The "spark on" signal causes transistor 77 to conduct and supply a strong base to emitter current to transistor 73 turning it on and allowing capacitor 69 to discharge through the primary of transformer $T_1$ and simultaneously allowing the discharge of capacitor 71. The parallel combination of capacitors 69, 71 and the primary of transformer $T_1$ may form a tuned circuit continually supplying unidirectional high voltage pulses to a pair of capacitors 79, 81 in threshold circuit 67 due to the presence of a diode 83. Capacitor 81 achieves substantially its full charge prior to capacitor 79 receiving substantially its full charge due to the presence of a resistor 85. When capacitor 81 is fully charged and capacitor 79 is sufficiently charged to cause a breakdown device, such as a neon filled tube 89 or the like, to conduct, there will be a gating signal supplied to a silicon controlled rectifier 91. This gating signal allows rectifier 91 to conduct thereby to discharge the charge on capacitor 81 through the primary winding of transformer $T_2$ and also supply the high voltage spark as desired. If there is little damping in the oscillatory circuit of transformer $T_1$, breakdown of the threshold device 89 and discharging of capacitor 81 through the primary winding of transformer $T_2$ may occur several times after ignitor circuit 15 is enabled. A diode 94 allows capacitor 81 to charge and further functions as a so called halfback diode to suppress the voltage across the primary winding of transformer $T_2$ as the field therein collapses after the discharge of capacitor 81. "Spark off" and "spark on" signals may also be applied to terminals $I_1$, $I_2$, respectively, by a more sophisticated control circuit of FIG. 4.

Figure 4:
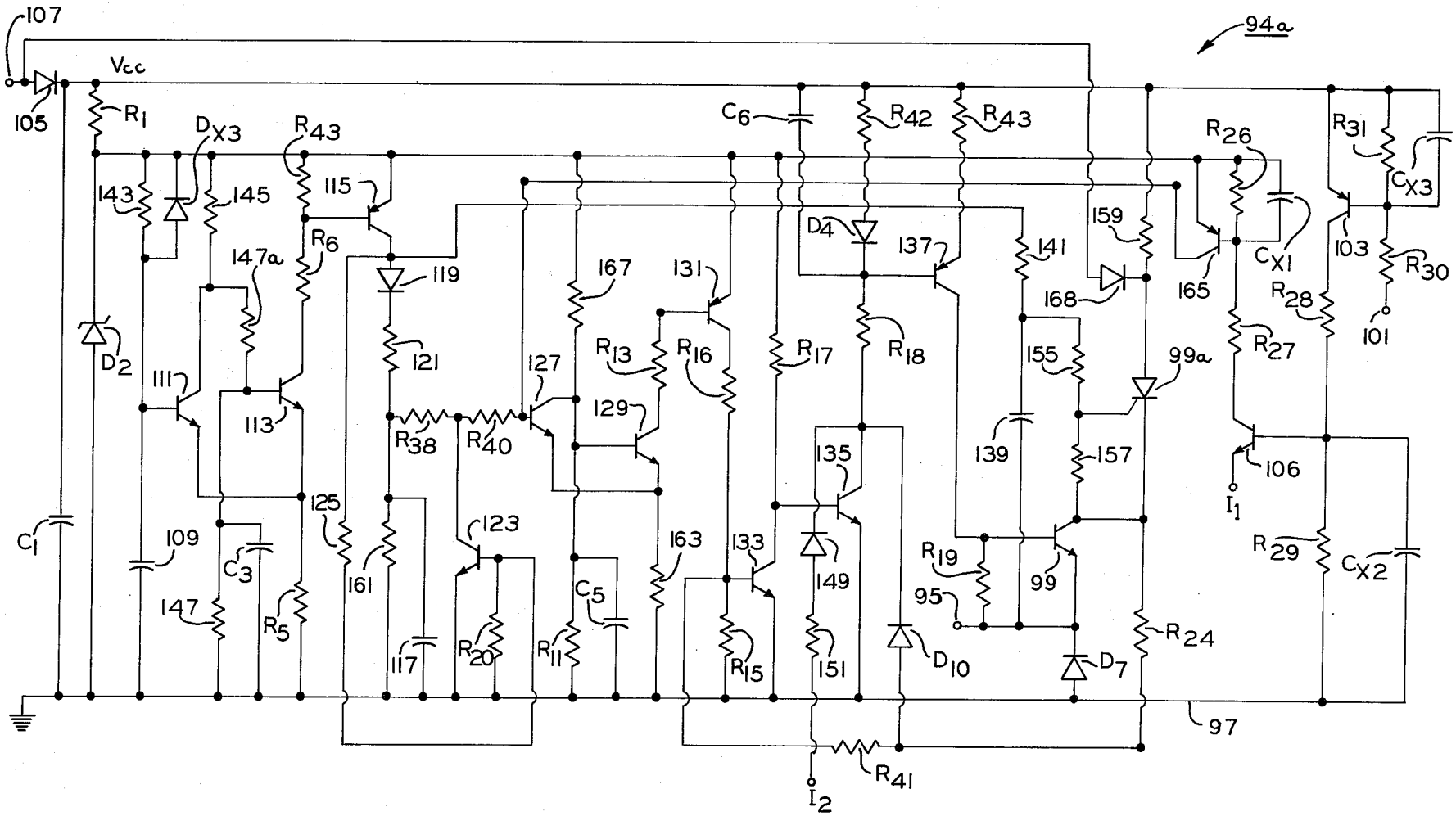
FIG. 4 is a schematic diagram of an alternative control system in one form of the invention.

Another control system 94*a* of FIG. 4 is, in many respects, similar to the control system 11 described above, but control system 94*a* has independent and additional advantageous features. It may be noted that circuit 94*a* is operable in response to either alternating current or direct current, but for purposes of simplicity of disclosure, the circuit is thought of as being operable in response to an alternating current source. In control system 94*a* gas, gas valve 21 is coupled between a terminal 95 and a neutral or ground terminal 97 and is enabled only when semiconductor devices, such as a transistor 99 and a silicon controlled rectifier 99*a*, conduct simultaneously. Flame sensing is somewhat the same in that a terminal 101 is connected to a flame sensing probe and functions to measure the impedance change when a flame appears at the burner. The appearance of a flame lowers the impedance between terminal 101 and ground 97 causing a transistor 103 to conduct which in turn turns on a transistor 106 supply a "spark off" signal to ignitor circuit on terminal $I_1$. When thermostat switch 25 closes, supply voltage is presented to a terminal 107, and in the event that the supply is an alternating current, a pulsating direct current $V_{cc}$ is supplied for operation of the semiconductor devices by way of a diode 105. Initially, there is no charge on a capacitor 109, and a transistor 111 is nonconducting and a pair of transistors 113, 115 are conducting. A capacitor 117 is charged through a diode 119 and a resistor 121 which has a relatively short time constant for charging the capacitor. A transistor 123 is turned on by way of a resistance 125, and a transistor 127 is turned off. A pair of transistors 129, 131 are turned on, and transistor 131, in turn, turns a transistor 133 on which, in turn, turns off a pair of transistors 135, 137 and transistor 99. At this time, ignitor circuit 15 is off due to no signal on terminal $I_2$, and gas valve 21 is off since transistor 99 is non-conducting. Transistor 115 charges a capacitor 139 to about 3 volts via a resistor 141 and gas valve coil 19. Transistor 111 remains off as capacitor 109 charges via a resistance 143 until a threshold voltage, as determined by the respective values of resistors 145, 147, 147*a*, is achieved at which time the charge on capacitor 109 is sufficient to enable transistor 111 to conduct. This charging of capacitor 109 provides an initial predetermined delay time prior to the enabling of either gas valve 21 or ignitor circuit 15.

When transistor 111 conducts, transistors 113, 115, 123 are turned off. The charge on capacitor 117 is high and sufficient to enable transistor 127 to conduct. Transistors 129, 131, 133 turn off enabling transistors 135, 137, 99. Ignitor circuit 15 is enabled by way of a diode 149 and a resistor 151, and conduction by transistor 99 triggers silicon controlled rectifier 99*a* by way of charged capacitor 139 and a resistive divider 155, 157. Conduction by transistor 99 and silicon controlled rectifier 99*a* allows current to flow by way of a diode 157 through terminal 95 and valve actuating coil or device 19 to ground 97. A resistor 159 provides the holding current for silicone controlled rectifier 153 in case voltage source 23 is an alternating current source.

If ignition occurs prior to the time capacitor 117 discharges i.e. (the lock-out time), the impedance between terminal 101 and ground is lowered by the presence of the flame providing base drive to transistor 103 and turning on that transistor as well as transistors 75, 106, 165. Conduction by transistor 75 turns ignitor circuit 15 off while conduction by transistor 165 charges capacitor 117 to a high value thereby to keep transistor 127 conducting and transistors 129, 131, 133 nonconducting with transistor 99 conducting to maintain the fuel flow into burner 17.

If a flame is established and then extinguished, there will be no flame current, and transistor 103 will cease conducting. With transistor 103 off, transistors 75, 106, 165 are also turned off. At this time, capacitor 117 is fully charged so that transistor 99 and gas valve 21 remain open, and since transistor 75 is now off, ignitor circuit 15 will again turn on to attempt reignition. This process can be repeated several times so long as successful ignition occurs on each ignition try. If the flame does not ignite, capacitor 117 will continue discharging and eventually reach a threshold value as determined primarily by the values of resistors 161, 163, 167 (typically about 15 seconds), and lock-out will occur with transistor 127 turning off, transistors 129, 131, 133 turning on, and transistors 99, 135, 137 turning off. Under these circumstances, gas valve 21 and ignitor circuit 15 will both be turned off, and system 94*a* is locked out. System 94*a* will stay in this lock-out condition until the supply voltage is removed for example, by opening the thermostatic switch contacts 25 so that the charge on capacitor 109 may dissipate, and thereafter, the system may be re-energized so that the sequence of operation outlined will repeat.

As previously noted, circuit 94*a* may be operable from either an alternating current source or a direct current source; therefore, it may also be noted that the circuit does not require any special gas valve for fail-safe operation. A standard, low cost, direct current gas valve may be employed in circuit 94*a*. Further, a fail-safe feature of circuit 94*a* is that transistor 99, SCR 99*a* and actuating coil 19, such as that of the aforementioned standard gas valve, are all connected in series, and the actuating coil is energized only if the transistor and SCR both are energized. For instance if SCR 99*a* is shorted or otherwise damaged, transistor 99 cannot be energized. Further, if for any reason transistor 99 is shorted, capacitor 139 cannot be charged, SCR 99*a* cannot be energized, and therefore actuating coil 19 cannot be energized to enable gas valve 21. Circuit 94*a* also provides another fail-safe feature. In the event of shorting or opening (one at a time) of any of the components thereof, transistor 99 remains open. Alternatively, transistor 99 may be energized before capacitor 139 is charged sufficiently charged so that SCR 99*a* cannot be energized thereby to obviate energization of actuating coil 19 for enabling gas valve 21.

Component Values For Circuit 13 of FIG. 2

| | |
|---|---|
| Resistors: 0.5 watts, 10% unless otherwise mentioned | |
| 55 | 5.1K, 10% |
| R2 | 39K |
| R3 | 5.6M |
| R4 | 560K |
| R5 | 100K |
| R6 | 5.6M |
| 43 | 560K |
| R8 | 270K |
| R9 | 2.2M |
| R10 | 1.0M |
| 47 | 47K |
| R12 | 390K |
| R13 | 100K |
| R14 | 2.2M |
| Capacitors: | |
| 45 | 47μf, 10V |
| 44 | .01μf |
| 51 | 33μf, 10V |
| 41 | .02μf |
| C5 | .1μf |
| C6 | .1μf |
| Quad dual input nor gates: | |
| 31, 33, 35, 37 | CA4001AE |
| Transistors: | |
| 39, 53 | 2N5172 |
| 61 | |
| 59 | 2N6076 |
| Diodes: | |
| D1, 49 | DA1704 |

Component Values For Circuit 15 of FIG. 3

| | |
|---|---|
| Resistors: 0.5 watts, 10% unless otherwise mentioned. | |
| R32 | 3.9K |
| R33 | 5.6K |
| R34 | 56 ohm |
| 85 | 3.9K |
| R36 | 1K |
| Capacitors: | |
| 69 | .47 μf |
| 71 | .1 μf |
| 79 | .1 μf |
| 81 | .22 μf |
| Transistors: | |
| 75 | 2N5172 |
| 77 | 2N6076 |
| 73 | 2N4424 |
| Diodes: | |
| 83, 94 | 2N5172 |
| SCR: | |
| 91 | C106B1 |

Component Values For Circuit 94a of FIG. 4

| | |
|---|---|
| Resistors: 0.5 watts, 10% unless otherwise mentioned. | |
| R1 | 150 ohms |
| 143, 141, 151 | 150K |
| 145, R39, R5, 125 | 47K |
| 147, 163, R20, R26, R27 | 100K |
| R6, R13, R38, R40, R41 | 10K |
| 121, 157, 159, R36 | 1K |
| 161 | 470K |
| R11 | 560K |
| 167 | 270K |
| R15, R18 | 8.2K |
| R16 | 27K |
| R17 | 18K |
| R19 | 220K |
| R24 | 56K |
| R28 | 390K |
| R30, 155 | 220 ohm |
| R31 | 2.2M |
| 125 | 5.6K |
| R10, R42 | 1.5K |
| R43 | 150 ohms |
| Capacitors: | |
| C1 | 220 μf, 25 volt |
| 109, 117 | 47 μf, 10 volt |
| C3, C5, C6, CX1, CX2, CX3 | .1 μf |
| 138 | 5 to 10 μf, 10 volt |
| Transistors: | |
| 111, 113, 123, 127, 41 | 2N5172 |
| 129, 133, 135, 106, 75 | 2N5172 |
| 115, 131, 165, 137, 77 | 2N6076 |
| 103 | 2N6225 |
| 73 | 2N4424 |
| 99 | D40D1 |
| SCR: | |
| 91, 153 | C106B1 |
| Diodes: | |
| 105, 168, D7 | IN5060 |
| DX3, 119, 149, D4, D10 | D1704 |
| D2 | 9.1V zener |

From the foregoing it is now apparent that a novel control system, spark ignitor circuit, flame detecting circuit, and two alternate control circuits for use therein have been described which meet the objects and advantages outlined hereinbefore, as well as others. Numerous modification will suggest themselves to those of ordinarly skilled in the art. For example, control circuit 94*a* of FIG. 4 is designed for operation with control coil 19 for gas valve 21 being grounded; however, transistor 137 could be eliminated, the base of transistor 99 enabled directly from the emitter of transistor 135, and the gas valve connected between terminal 107 and the anode of diode 168. Also gas valve might be left in the position illustrated to meet for example, American Gas Association or Underwriters Laboratory requirements by substituting a PNP transistor for transistor 99 and eliminating transistor 137 so that the PNP substitute for transistor 99 is enabled by the conduction of transistor 135. Numerous other modification may be made by those skilled in the art without departing from the spirit or scope of the invention as set out in the claims which follow.

What I claim as new and desire to secure by Letters Patent of the United States is:

1. A low voltage control system for a fuel burner having a fuel valve and adapted to be operable from a direct current and comprising:

means for actuating the fuel valve to enable flow of a combustible fuel from the burner;

means for spark igniting the fuel emitted from the burner;

means for detecting a flame disposed near the burner, the impedance between the detecting means and a point of reference potential being greater when no flame is present at the burner and lower when a flame is present at the burner;

a semiconductor device coupled to the detecting means for conducting current only when the impedance between the detecting means and the point of reference potential is lower thereby to indicate the presence of a flame; and means responsive to the current conducted by the semiconductor device for disabling the spark igniting means.

2. A control system as set forth in claim 1, wherein the disabling means comprises another semiconductor device coupled to and enabled by the first named semiconductor device for conducting only when the first named semiconductor device conducts, conduction of the other semiconductor device disabling the spark igniting means.

3. A control system as set forth in claim 1, wherein the spark igniting means comprises a low voltage to high voltage converter, and means near the burner for defining a spark gap, the converter being coupled to the spark gap defining means to cause an arc across the spark gap when enabled.

4. A control system as set forth in claim 3, wherein the low voltage to high voltage converter includes first and second inductive voltage step-up devices, and a threshold discharge circuit for interconnecting the first and second step-up devices, the first step-up device receiving a low voltage input and the second step-up device providing a high voltage output to the spark gap defining means.

5. A control system as set forth in claim 4, further comprising means in circuit with the first transformer for inducing oscillations therein when current from the low voltage input is allowed to flow therethrough.

6. A control system as set forth in claim 5, wherein the inducing means is generally constituted by a capacitor.

7. A control system as set forth in claim 1, further comprising means responsive to energization of the system for enabling the actuating means thereby to provide fuel flow to the fuel burner a predetermined time after system energization.

8. A control system as set forth in claim 7, further comprising other means responsive to energization of the system for enabling the spark igniting means a second predetermined time after system energization.

9. A control system as set forth in claim 7, further comprising means responsive to system energization for disabling the actuating means thereby to stop fuel flow to the burner a second predetermined time after system energization and only if the semiconductor device is in a non-conducting state at the expiration of the second predetermined time.

10. A control system as set forth in claim 1, further comprising means responsive to system energization for predeterminately delaying the spark igniting means to insure an initial purge time to effect a proper mixture of fuel and air.

11. A control system as set forth in claim 10, further comprising means operable generally subsequent to the operation of the delaying means for predeterminately locking out the fuel valve in the event the detecting means does not detect flame ignition at the fuel burner.

12. A control system as set forth in claim 7, further comprising another semicoonductor device in series circuit relation with the actuating means, and the other semiconductive device being rendered conductive by the enabling means to connect the actuating means to a low voltage electrical source generally at the predetermined time after system.

13. A control system as set forth in claim 12, wherein the actuating means includes an energizing coil, and the other semiconductor device being connected with the energizing coil in the series circuit relation.

14. A control system as set forth in claim 12, optionally operable from an alternating current source, and further comprising means for rectifying the current of the alternating current source and generally constituting a rectified current source for the first named and other semiconductor devices, the actuating means being connected to the alternating current source when the other semiconductor device is conducting.

15. A control system as set forth in claim 14, further comprising means coupled to the rectifying means for providing a holding current to maintain the other semiconductor device conductive despite reversal of the direction of current flow in the actuating means.

16. A control system as set forth in claim 1, further comprising means operable generally for supplying current at a value great enough to the actuating means to effect the operation thereof.

17. A control system as set forth in claim 16, further comprising means for providing a holding current upon the operation of the actuating means to maintain it operative.

18. A control system as set forth in claim 16, further comprising means energized in response to a certain voltage level in the system upon the energization thereof for effecting the operation of the current supplying means.

19. A control system as set forth in claim 18, further comprising means for applying a holding current to the actuating means subsequent to its operation by the current supplying means to maintain the actuating means operative only so long as the operation effecting means is energized.

20. A direct current energizable low voltage control system for enabling a fuel valve of a fuel burner comprising:

means for actuating the fuel valve and a semiconductor device in series circuit relation therewith wherein current flow therethrough enables the fuel valve to effect a flow of a combustible fuel from the burner;

means responsive to system energization for rendering the semi-conductor device conductive a predetermined time after system energization;

means for igniting the fuel emitted from the fuel burner;

means disposed near the fuel burner for detecting when a flame is present; and means coupled to the detecting means for interrupting the current flow through the actuating means another predetermined time after system energization only if the detecting means does not indicate that a flame is present.

21. A control system as set forth in claim 20, further comprising means adapted to be charged during the first named predetermined time and discharged through the actuating means at the expiration of the first named predetermined time for aiding in the actuation of the fuel valve.

22. A control system as set forth in claim 20, wherein the control system is operable from an alternating current source with the actuating means connected to the alternating current source, and further comprising means connected to the alternating current source for rectifying the alternating current thereby to constitute a rectified current source for the semiconductor device.

23. A control system as set forth in claim 22, further comprising means coupled to the rectified current source for providing a holding current to maintain semiconductor device conductive despite reversal of the direction of current flow in the actuating means.

24. A control system as set forth in claim 20, wherein the igniting means comprises a spark generating system including a low voltage to high voltage converter and a spark gap defining means near the burner, the converter being coupled to the spark gap defining means to cause an arc across the spark gap when enabled.

25. A control system as set forth in claim 24, wherein the converter includes first and second voltage step-up transformers each having primary and secondary windings, means in circuit with the first transformer for inducing oscillations therein when current flows therethrough, and a threshold discharge circuit having an input coupled to the first transformer secondary winding and intermittently discharging through the second transformer primary winding to induce in the second transformer secondary winding a high voltage to be applied to the spark gap.

26. A low voltage thermostatically energizable control system for a combustible fuel burner having a fuel flow control valve comprising:

means for actuating the control valve to effect flow of a combustible fuel from the fuel burner;

means near the fuel burner for indicating when a flame is present;

means near the fuel burner for defining a spark gap;

a low voltage to high voltage converter coupled to the spark gap defining means for causing an arc across the spark gap when enabled and including a pair of step-up transformer devices, and a threshold discharge circuit interconnecting the step-up transformer devices, one of the step-up transformer devices receiving a low voltage input and providing an increased voltage output to the threshold discharge circuit and the other of the step-up transformer devices being enabled by a discharge of the threshold discharge circuit to provide a high voltage output to the spark gap defining means; and means in circuit relation with the one step-up transformer device for inducing oscillations therein when current from a low voltage source is allowed to flow therethrough.

27. A control system as set forth in claim 26, wherein the impedance between the indicating means and a point of reference potential is greater when no flame is present at the burner and lower when a flame is present at the burner.

28. A control system as set forth in claim 26, further comprising a semiconductor device coupled to the indicating means for conducting current only when the impedance between the indicating means and a point of reference potential therefor is lower so as to indicate the presence of a flame, and means responsive to the current conducted by the semiconductor device for disabling the converter.

* * * * *